US006524174B2

(12) United States Patent
Bae et al.

(10) Patent No.: US 6,524,174 B2
(45) Date of Patent: Feb. 25, 2003

(54) CLAMP FOR CONNECTING/ DISCONNECTING A ROTARY HEAD TO/ FROM A SPINDLE IN APPARATUS FOR MANUFACTURING A SEMICONDUCTOR DEVICE

(75) Inventors: Gi-Sung Bae, Yongin (KR); Min-Gyu Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 41 days.

(21) Appl. No.: 09/847,286

(22) Filed: May 3, 2001

(65) Prior Publication Data

US 2002/0077050 A1 Jun. 20, 2002

(30) Foreign Application Priority Data

Dec. 18, 2000 (KR) ..... 2000-077823

(51) Int. Cl.[7] ..... B24B 47/02

(52) U.S. Cl. ..... 451/397; 451/41; 451/287; 451/288; 451/369; 451/385; 451/397; 451/398; 451/402; 269/91; 269/92; 269/94; 269/97

(58) Field of Search ..... 481/41, 285, 286, 481/287, 288, 365, 385, 397, 398, 402; 269/91, 92, 94, 97

(56) References Cited

U.S. PATENT DOCUMENTS 5,695,347 A * 12/1997 Somerset ..... 439/67

5,702,292 A 12/1997 Brunelli et al.

* cited by examiner

*Primary Examiner*—Joseph J. Hall, III
*Assistant Examiner*—Shantese McDonald
(74) *Attorney, Agent, or Firm*—Volentine Francos, PLLC

(57) ABSTRACT

An apparatus for manufacturing a semiconductor device includes a rotatable spindle, a head detachably connected to the spindle, and a clamp for clamping outer circumferential surfaces of the spindle and the head to one another so that the head may be driven by the spindle. The clamp has an annular clamping frame sized to encircle the outer circumferential surfaces of the spindle and the head, a projection disposed on one end of the clamping frame, a lever pivotally connected to the other end of the clamping frame, and a fastener pivotally connected to the lever and configured to hook over the projection. Once the fastener is hooked over the projection, the lever is pivoted to force the ends of the annular clamping frame together and thereby produce a clamping force that secures the spindle and head to one another. The clamp can be manipulated easily and with a simple motion to clamp the head to the spindle. Also, the parts of the clamp generate little mechanical friction. Accordingly, the head can be quickly connected to and disconnected from the spindle, and such operations will not produce particles that could contaminate the semiconductor wafer.

18 Claims, 7 Drawing Sheets

CLAMP FOR CONNECTING/ DISCONNECTING A ROTARY HEAD TO/ FROM A SPINDLE IN APPARATUS FOR MANUFACTURING A SEMICONDUCTOR DEVICE

BACKGROUND OF THE INVENTION

1. Field of the Invention

The present invention relates to a rotary device of an apparatus for manufacturing a semiconductor device. More particularly, the present invention relates to a rotary head driven by a spindle in an apparatus for manufacturing a semiconductor device, and to the clamping structure that clamps the head to the spindle.

This is a counterpart of Korean Patent Application No. 2000-77823, filed Dec. 18, 2000, the contents of which are incorporated herein by reference in their entirety.

2. Description of the Related Art

A chemical-mechanical planarization or polishing (CMP) process removes material from the surface of wafers in the fabrication of integrated circuits of a semiconductor device. A conventional apparatus for performing a CMP process is disclosed in U.S. Pat. No. 5,702,292 to Brunelli et al.

Referring to FIG. 1, the conventional CMP apparatus includes a head 14 that picks up wafers using suction or surface tension. The head 14 is rotated by a spindle 12. The head 14 and spindle 12 are connected by a clamp 16.

The clamp 16 comprises a clamping frame and a bolt 18. The head 14 is connected to or disconnected from the spindle 12 by tightening or loosening the bolt 18 using a special tool such as a torque wrench. Thus, the operation of connecting or disconnecting the head 14 to or from the spindle 12 is complicated and takes time, which detracts from the efficiency at which the overall CMP process can be carried out.

Also, there is a problem in that particles are produced by the screw threads of the bolt 18 when the bolt is tightened or loosened. These particles fall onto the head 14 and then onto a polishing pad due to the vibration and rotation of the head 14 during the CMP process. Particles on the polishing pad may become a major cause of scratches on the surface of the wafers being polished.

SUMMARY OF THE INVENTION

It is therefore an object of the present invention to provide an improved apparatus for manufacturing a semiconductor device, in which a working head thereof can be connected to or disconnected from a spindle without using special tools, whereby the overall efficiency of the manufacturing process is enhanced.

It is another object of the present invention to provide an improved apparatus for manufacturing a semiconductor device, which produces a minimal amount of particles when a working head thereof is connected to or disconnected from a spindle, whereby such an operation does not produce manufacturing defects in the semiconductor device.

The present invention achieves these objects by providing a clamp that can be manipulated easily and with a simple motion to clamp the head to the spindle. The parts of the clamp generate little mechanical friction during the operation of connecting the head to or disconnecting the head from the spindle.

The clamp comprises an annular clamping frame encircling the outer circumference surfaces of the spindle and the head, a projection disposed on one end of the clamping frame, a lever pivotally supported by the other end of the clamping frame, and a fastener having one end pivotally connected to the lever and the other end configured to hook onto the projection.

The clamping frame comprises a first arcuate arm having a free end from which the projection protrudes, a second arcuate arm having a free end to which the lever is pivotally connected, and a hinge connecting the other ends of the first and second arms.

First, the annular clamping frame is positioned around and over the head and the spindle. The spindle and head may have outer circumferential flanges, and the clamping frame has a groove formed in the inner circumferential surface thereof. The flanges of the head and the spindle are received by the groove in the annular clamping frame.

The fastener is moved to a position at which it can be hooked onto (or unhooked from) the projection by rotating the lever in a first direction. Once the lever is hooked onto the projection, the lever is rotated in a second direction opposite to the first direction to force the projection in a direction that brings the free ends of the arms of the clamping frame together and thereby produces a clamping force that secures the spindle to the head.

The present invention also includes a safety mechanism for preventing the lever from being rotated by in the first direction a reaction force exerted thereon after the clamp has connected the head and spindle to one another. The safety mechanism includes a rod extending from the free end of the second arm and through the lever, a locking member mounted to the rod so as to be rotatable relative to the rod and slidable therealong, and at least one spring disposed on the rod and biasing the locking member so as to resiliently support the rod. Once the lever is closed, the rod engages the lever at an upper surface of the lever to prevent the lever from lifting off of the clamping frame and opening.

DETAILED DESCRIPTION OF THE PREFERRED EMBODIMENTS

The present invention now will be described more fully hereinafter with reference to the accompanying drawings. Note, like numbers designate like elements throughout the drawings.

Figure 1:
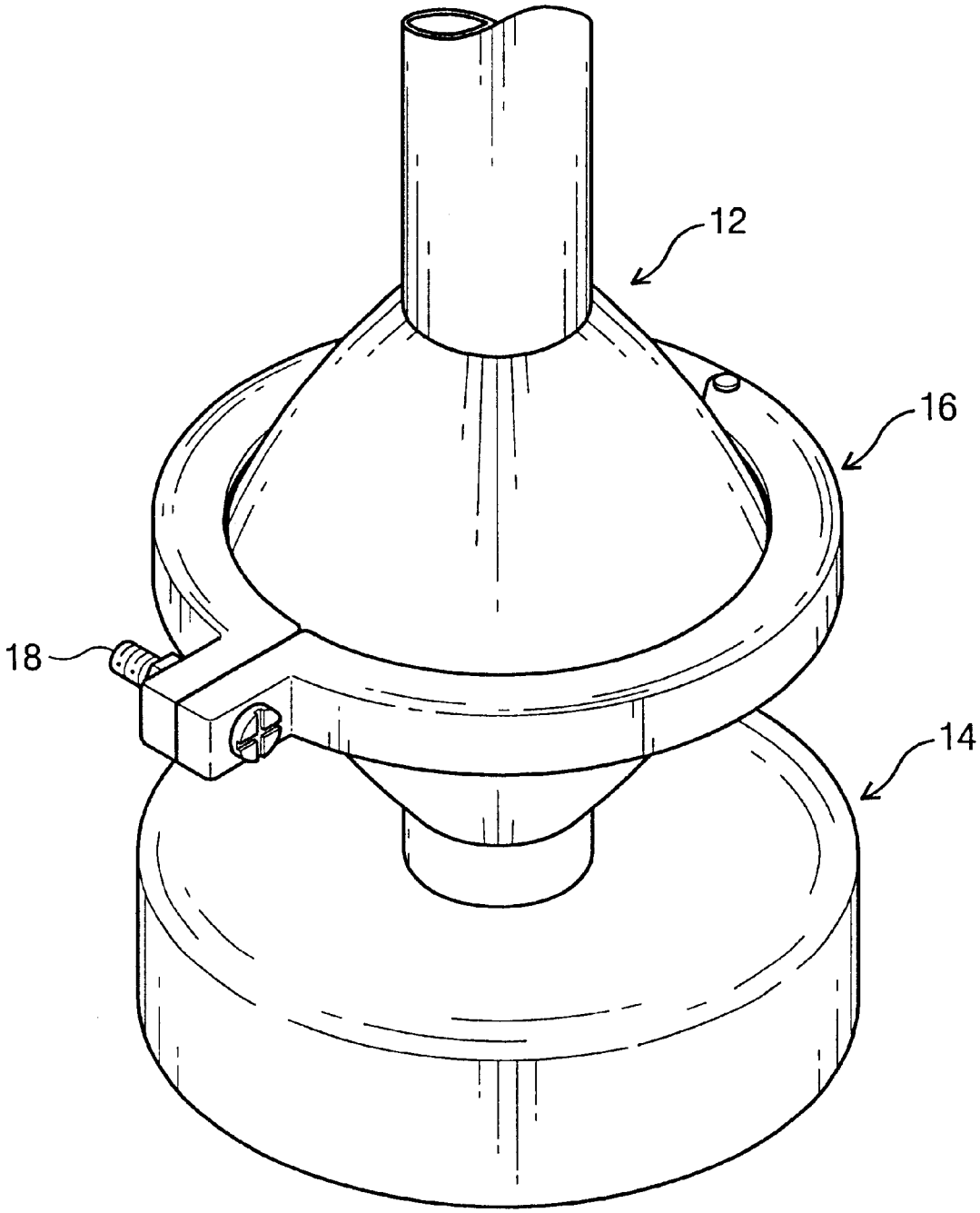
Fig. 1 (Prior Art)
FIG. 1 is a perspective view of a head, a spindle and a clamp of a conventional CMP apparatus for use in manufacturing a semiconductor device.
Figure 2:
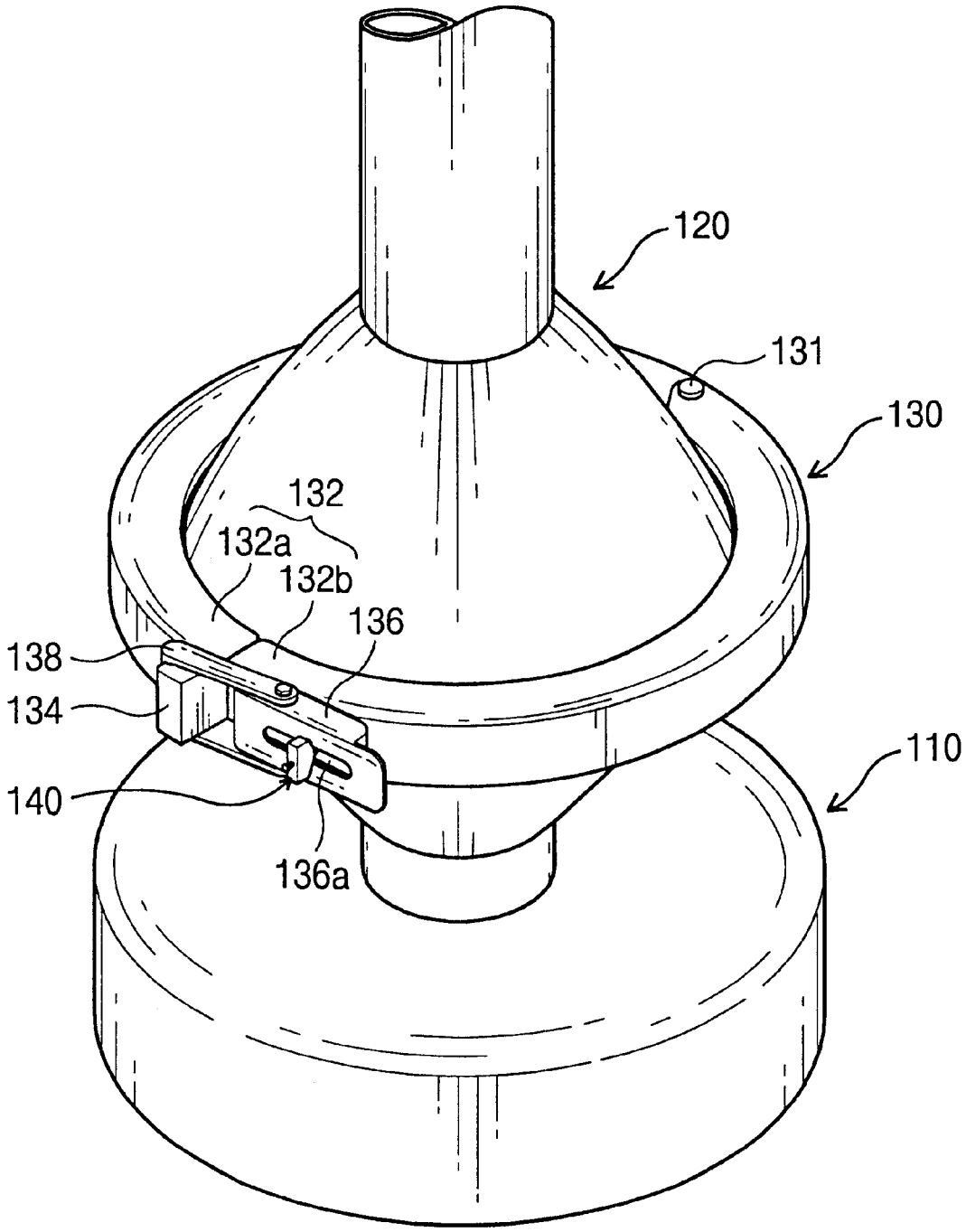
FIG. 2 is a perspective view of a preferred embodiment of a rotary device comprising a head, a spindle and a clamp, of a CMP apparatus according to the present invention.
Figure 3:
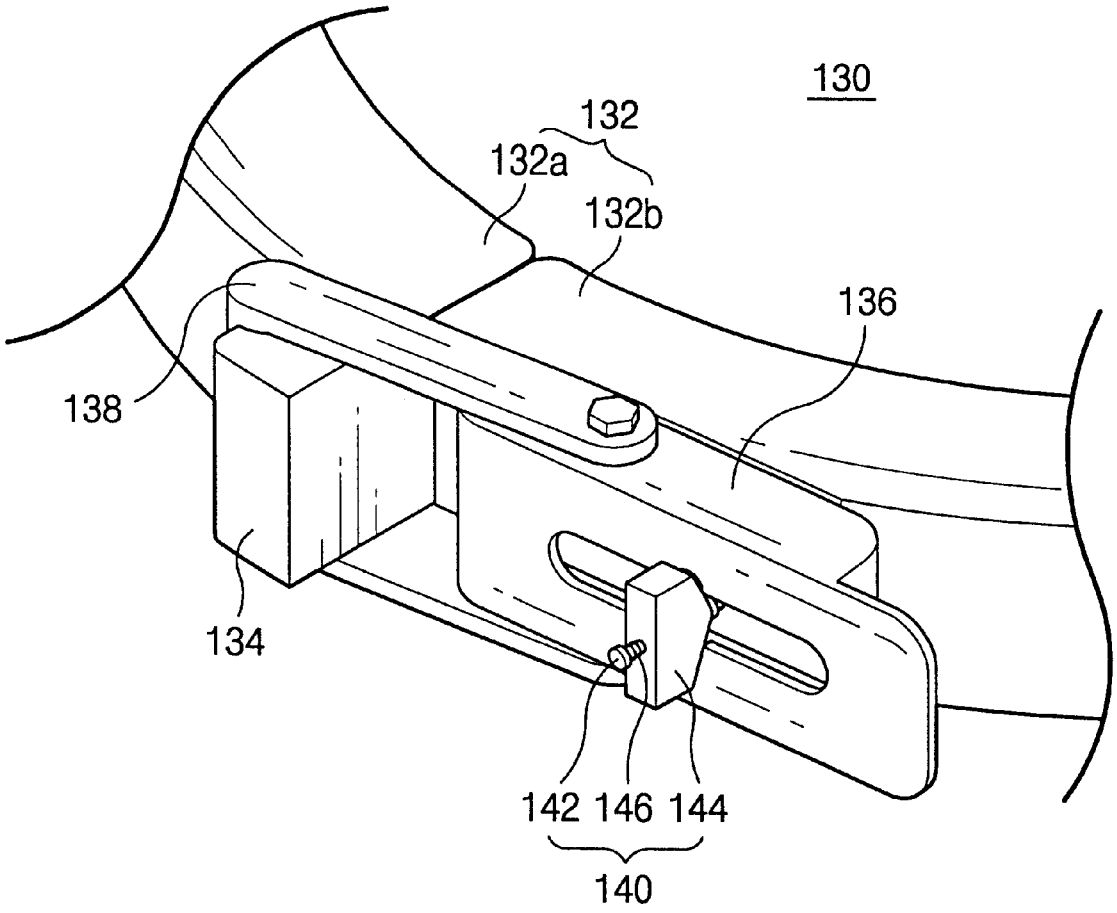
FIG. 3 is a partial perspective view of the clamp of the rotary device of the CMP apparatus according to the present invention.

Referring now to FIGS. 2 and 3, a CMP apparatus for use in manufacturing a semiconductor device comprises a head 110, a spindle 120 and a clamp 130. The head 110 is a wafer chuck that grasps a wafer using a vacuum or surface tension. The head 110 is connected to the spindle 120 by the clamp 130 so as to be rotated by the spindle. More specifically, the head 110 and the spindle 120 each have an outer circumferential flange, and these outer circumferential flanges of the head 110 and the spindle 120 are clamped together face-to-face by the clamp 130 to connect the head 110 to the spindle 120.

As shown in FIGS. 2 and 3, the clamp 130 comprises an annular clamping frame 132 encircling the outer surfaces of the circumferential flanges of the head 110 and the spindle 120, a projection 134 protruding at one end of the clamping frame 132, a lever 136 pivotally connected to the other end of the clamping frame 132, and a fastener 138 having a first end pivotally connected to the lever 136 and a second end configured to hook onto the projection 134. For instance, the second end of the fastener 138 has the form of a loop that can be hung on the projection 134.

The clamping frame 132 itself includes a first arcuate (semi-circular) arm 132*a* and a second arcuate (semi-circular) arm 132*b*. The first and second arms 132*a*, 132*b* are pivotally connected to each other by a hinge 131. The first and second arms 132*a*, 132*b* have grooves 133 formed, respectively, in inner circumferential surfaces thereof to receive the flanges of the spindle 120 and the head 110, as shown in FIGS. 4A–4D.

The projection 134 is disposed on one end of the first arm 132*a* of the clamping frame 132 at a free end thereof. The projection 134 can be integrated with or a unitary part of the first arm 132*a*. The lever 136, on the other hand, is rotatably or pivotally supported by the second arm 132*b* of the clamping frame 132 at a free end thereof that confronts the free end of the first arm 132*a*.

Figure 4A:
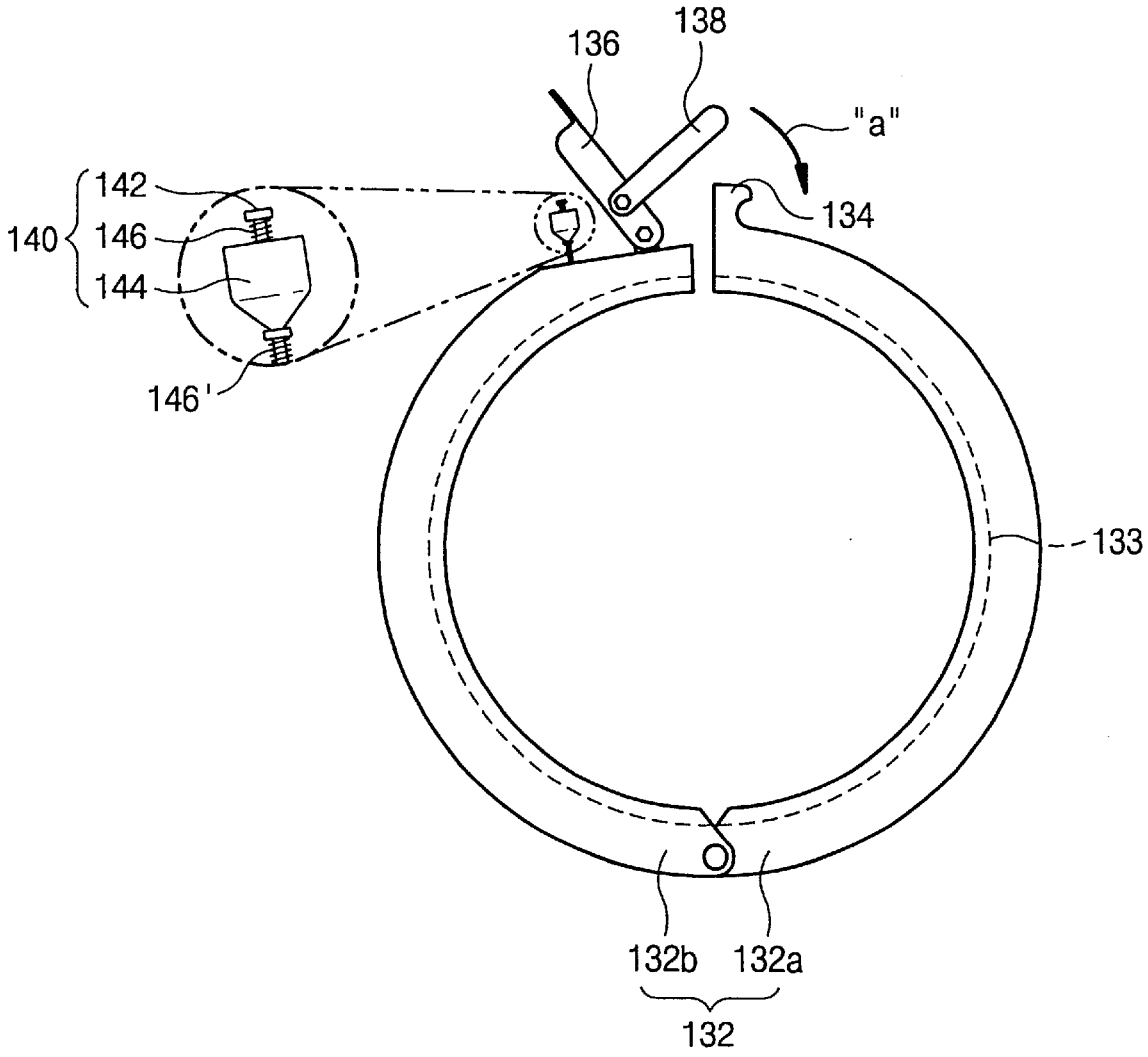
FIG. 4A to FIG. 4D are perspective views of the clamp, and together illustrate the sequence by which the clamp is operated to secure the head to the spindle.
Figure 4B:
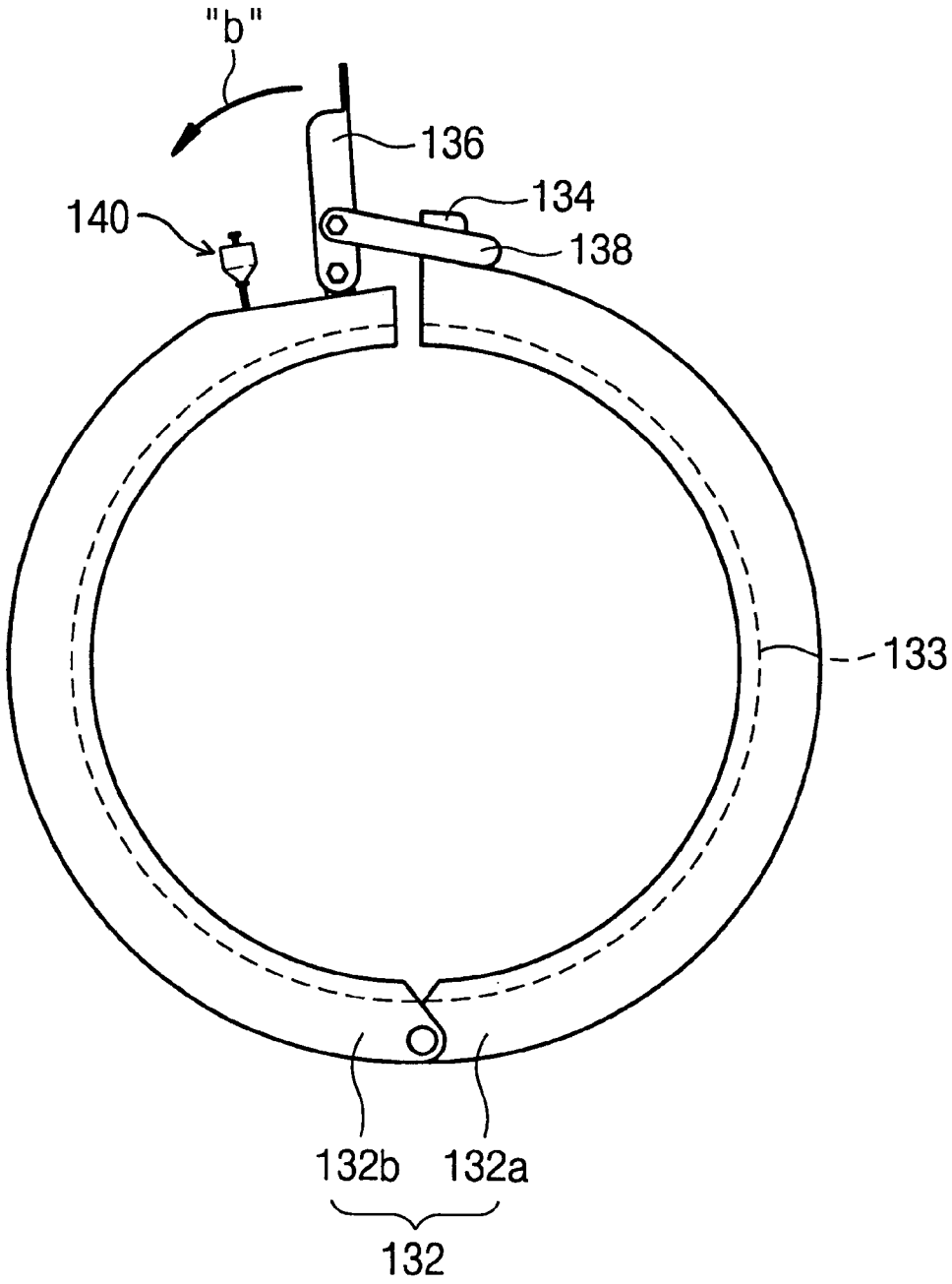

As shown in FIG. 4A, when the lever 136 is pivoted in a first direction, i.e., in the direction indicated by arrow "a", the fastener 138 is moved to a position at which it can be easily hung on or unhooked from the projection 134. As shown in FIG. 4B, once the fastener 138 is hung on the projection 134, the lever 136 is then rotated in the opposite direction, i.e., the direction indicated by arrow "b". In this case, the fastener 138 is moved by the lever 136 to force the projection 134, and hence the end of the first arm 132*a* integral with the projection 134, toward the end of the second arm 132*b* to which the lever 136 is connected.

Figure 4C:
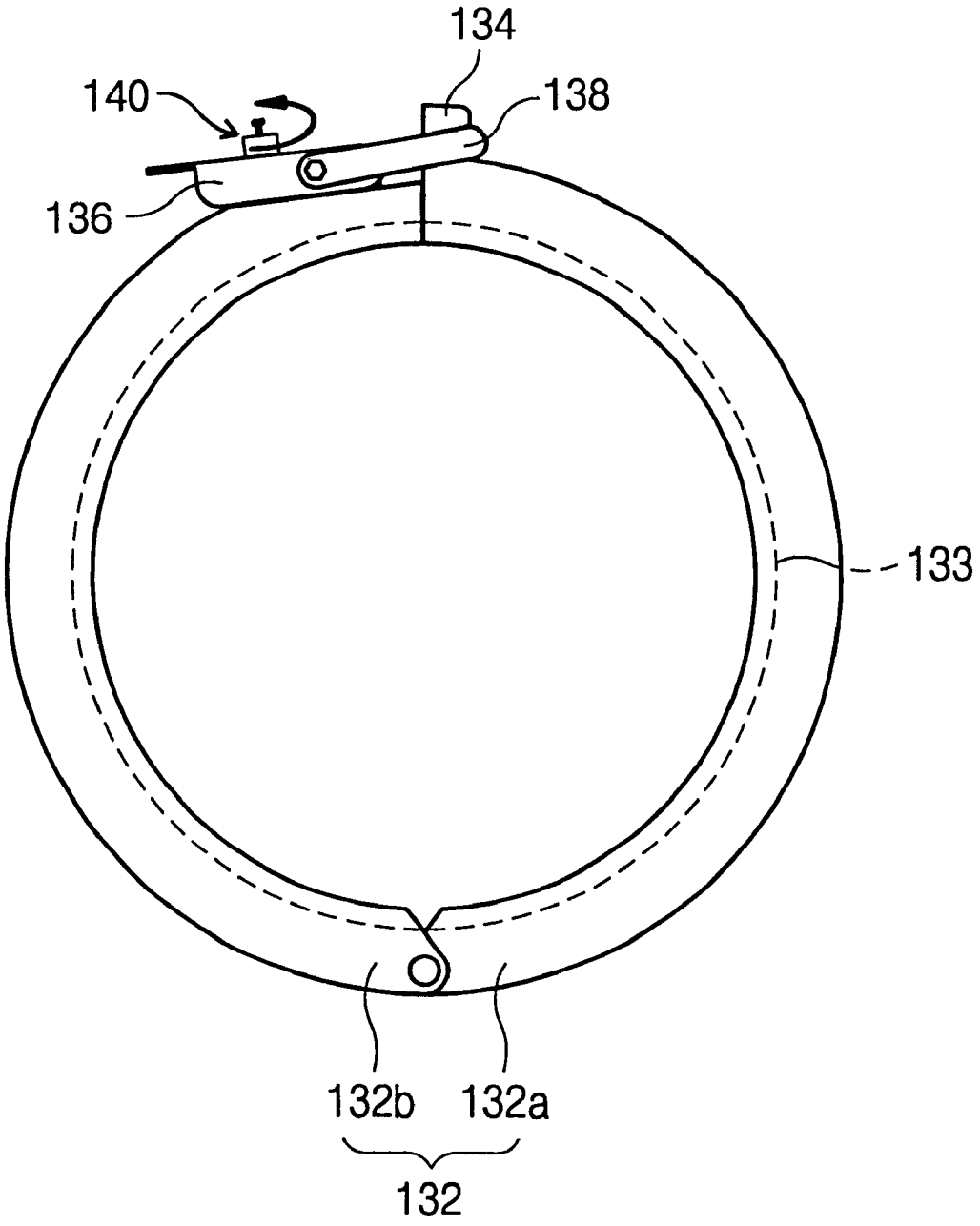
Figure 4D:
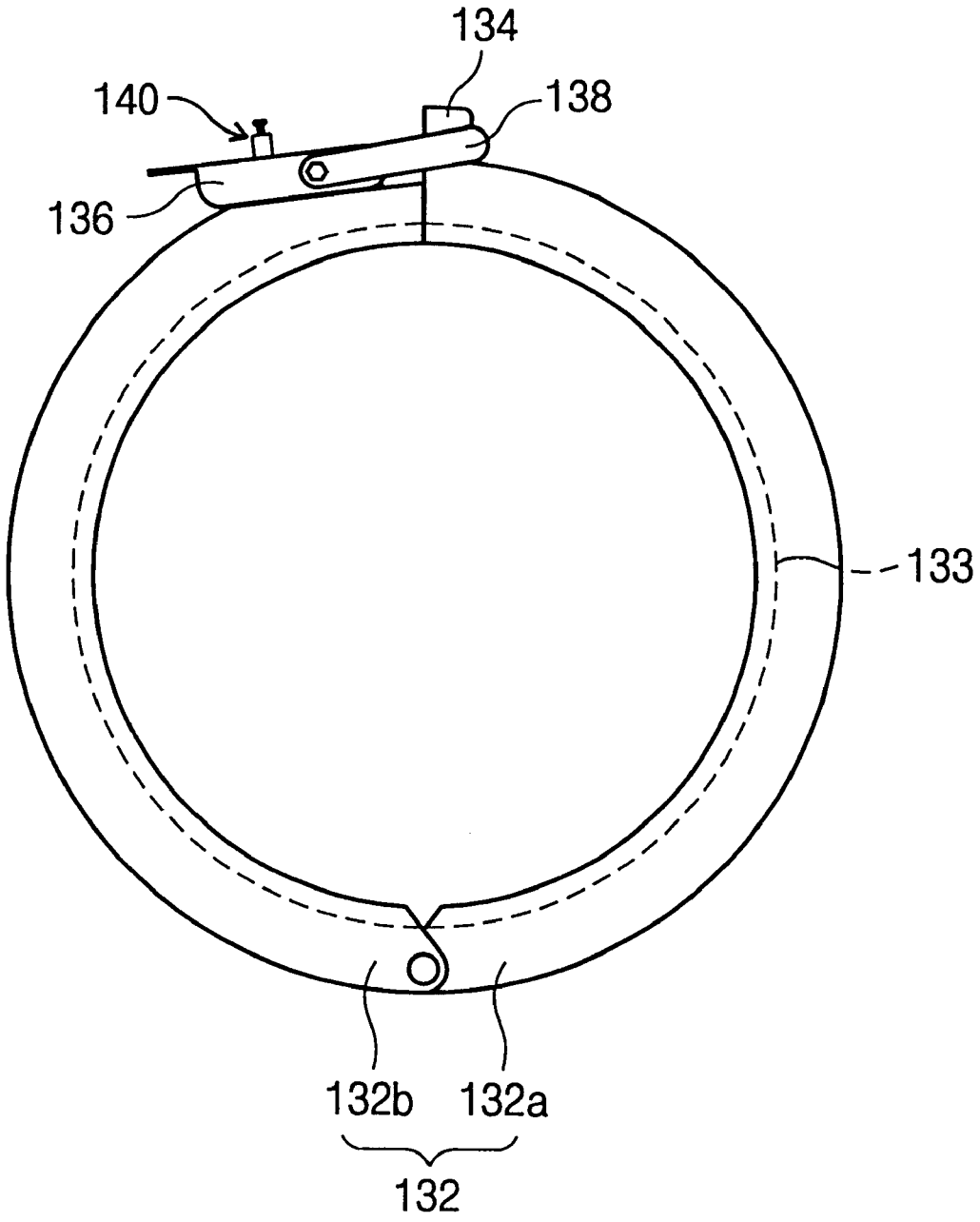

The first end of the fastener 138 is pivotally connected to the lever 136 at a location offset from the location at which the end of the lever 136 is pivotally connected to the arm 132*b* of the clamping frame 132. The lever 136, fastener 138 and projection 134 may thus constitute a toggle joint by which the lever 136 can be snapped into position. That is, once the fastener is hooked onto the projection 134 and the lever 136 is fully rotated in the direction shown by arrow "b" in FIG. 4B, the lever 136 is self-held in place against the outer surface of the arm 132*b*, as shown in FIG. 4C, due to the kinematics of the structure. In this state, the clamping frame 132 holds the flanges of the spindle 120 and the head 110 together as seated in the grooves 133.

The clamp 130 of the present invention further includes a safety mechanism 140 for preventing the lever 136 from being opened, i.e., moved in the direction of arrow "a", by the reaction force of the fastener 138 after the lever 136 has been moved to the closed position shown in FIG. 4C. The safety mechanism 140 comprises a rod 142, a locking member 144 through which the rod extends freely such that the locking member can be slid axially along and rotated relative to the rod 142, and upper and lower springs 146, 146' disposed on the rod 142.

The rod 142 is fixed to the end of the second arm 132*b* and will pass through an opening 136*a* in the lever 136 when the lever 136 is pivoted in the direction of arrow "b" to the closed position shown in FIG. 4C. Furthermore, the locking member 144 has a width in one direction that is greater than the width of the opening 136*a* in the lever 136, and a width in another direction that is less than the width of the opening 136*a*. Thus, the locking member 144 can be rotated into engagement with the upper surface of the lever 136 once the lever 136 is in the closed position, as shown best in FIG. 3. The upper and lower springs 146, 146' resiliently support the locking member 144.

The operation of securing the head and spindle 100 and spindle 120 using the clamp 130 of the CMP apparatus will now be described.

To secure the head 110 to the spindle 120, first, the flanges of the head 110 and the spindle 120 are brought into contact with each other. Then, the annular clamping frame 132 of the clamp 130 is positioned around the contacting flanges of the head 110 and the spindle 120. Subsequently, as shown in FIG. 4A, the lever 136 is rotated in the first direction "a", whereby the fastener 138 is moved to a position at which the looped end thereof can be hooked onto the projection 134. Once the fastener 138 is hooked onto the projection 134, as shown in FIG. 4B, the lever 136 is rotated in the second direction "b". Thus, as shown in FIG. 4C, the fastener 138 forces the projection 134 and hence, the free end of the second arm 132*a* of the clamping frame 132, towards the free end of the second arm 132*b* of the clamping frame 132. This action generates a clamping force that acts to secure the spindle 120 and the head 110 to one another.

At this time, the locking member 144 of the safety mechanism 140 and the rod 142 pass through the opening 136*a* in the lever 136. The locking member 144 is then pulled outwardly against the force of spring 146 and is rotated 90 degrees. Accordingly, the locking member 144 is engaged with the lever 136 to prevent the lever 136 from pivoting open in the first direction "a" under the reaction force to the clamping force produced by the clamp 130.

Obviously, the operation of disconnecting the head 110 from the spindle 120 is carried out in reverse.

As can be appreciated from the foregoing description, the present invention provides an apparatus for manufacturing a semiconductor device in which it is easy and simple to connect or disconnect a head to or from a spindle, i.e., without the need for special tools. Accordingly, the operations of connecting and disconnecting the head to and from the spindle can be carried out efficiently.

Also, the present invention generates a minimal amount of particles during the operations of connecting and disconnecting the head to and from the spindle. Thus, the devices being manufactured experience few process defects associated with the use of the present invention.

Finally, although the present invention has been described in connection with the preferred embodiment thereof, various changes thereto and modifications thereof will become apparent to those of ordinary skill in the art. All such changes and modifications are thus seen to be within the true spirit and scope of the present invention as defined by the following claims.

What is claimed is:

1. In apparatus for manufacturing a semiconductor device, a rotary device comprising:

a spindle, a rotary head, and a clamp clamping said spindle and said head to one another, said clamp including an annular clamping frame comprising first and second arcuate arms encircling said spindle and said head and having free ends, respectively, that confront each other, a projection protruding from the free end of said first arm, a lever pivotally connected to the free end of said second arm, and a fastener having one end pivotally connected to said lever and another end configured so as to be hookable onto said projection, said fastener being pivotally connected to said lever at a location offset from that at which said lever is pivotally connected to the free end of said second arm, and said lever, said fastener and said projection collectively constituting a toggle joint, whereby said fastener is movable, by pivoting said lever in a first direction, to an open position at which the fastener can be hooked onto or unhooked from said projection, and whereby once said fastener is hooked onto said projection, said fastener is movable, by pivoting said lever in a second direction opposite to said first direction, to a closed position whereat said free ends of the arms of the clamp member are forced toward each other by said toggle joint to thereby generate a clamping force that acts to secure said spindle and said head to one another.

2. The rotary device according to claim 1, wherein said spindle and said head have outer circumferential flanges, respectively, and said annular clamping frame has a groove extending along the inner circumferential surface thereof, said flanges being received in said groove.

3. The rotary device according to claim 1, wherein said first arm of the clamping frame is arcuate, said second arm of the clamping frame is arcuate, and said first and second arms are hinged to one another at respective second ends thereof remote from said free ends.

4. The rotary device according to claim 3, wherein said projection is unitary with said first arm.

5. The rotary device according to claim 1, wherein said another end of said fastener has the form of a loop.

6. The rotary device according to claim 1, wherein said head is a rotary wafer chuck of a chemical mechanical polishing apparatus.

7. In apparatus for manufacturing a semiconductor device, a rotary device comprising:

a spindle, a rotary head, and a clamp clamping said spindle and said head to one another, said clamp including an annular clamping frame comprising first and second arcuate arms encircling said spindle and said head and having free ends, respectively, that confront each other, a projection protruding from the free end of said first arm, a lever pivotally connected to the free end of said second arm so as to be movable between open and closed positions, a fastener having one end pivotally connected to said lever and another end hooked onto said projection, and a safety mechanism that locks said lever in said closed position.

8. The rotary device according to claim 7, wherein said lever has an opening extending therethrough, and said safety mechanism comprises a rod extending from the free end of said second arm through said opening in the lever, and a locking member mounted to said rod so as to be freely rotatable relative to said rod, said locking member being disposed over said lever as engaged therewith, and said locking member having a width in one direction that is greater than a width of said opening in the lever, and a width in another direction that is less than the width of said opening in the lever, such that said locking member is rotatable to a position at which it can pass through the opening in the lever and thereby allow the lever to be pivoted in said first direction.

9. The rotary device according to claim 8, wherein said locking member is also slidable axially along said rod, and said safety mechanism further comprises at least one spring disposed on said rod and engaging said locking member so as to resiliently support said locking member.

10. The rotary device according to claim 7, wherein said head is a rotary wafer chuck of a chemical mechanical polishing apparatus.

11. In apparatus for manufacturing a semiconductor device, a rotary device comprising:

a spindle, a rotary head, and a clamp clamping said spindle and said head to one another, said clamp including an annular clamping frame comprising first and second arcuate arms encircling said spindle and said head and having free ends, respectively, that confront each other, a projection protruding from the free end of said first arm, a lever pivotally connected to the free end of said second arm, a fastener having one end pivotally connected to said lever and another end configured so as to be hookable onto said projection, said fastener being pivotally connected to said lever at a location offset from that at which said lever is pivotally connected to the free end of said second arm, and said lever, said fastener and said projection collectively constituting a toggle joint, whereby said fastener is movable, by pivoting said lever in a first direction, to an open position at which the fastener can be hooked onto or unhooked from said projection, and whereby once said fastener is hooked onto said projection, said fastener is movable, by pivoting said lever in a second direction opposite to said first direction, to a closed position whereat said free ends of the arms of the clamp member are forced toward each other by said toggle joint to thereby generate a clamping force that acts to secure said spindle and said head to one another, and a safety mechanism that locks said lever in said closed position.

12. The rotary device according to claim 11, wherein said lever has an opening extending therethrough, and said safety mechanism comprises a rod extending from the free end of said second arm through said opening in the lever, and a locking member mounted to said rod so as to be freely rotatable relative to said rod, said locking member being disposed over said lever as engaged therewith, and said locking member having a width in one direction that is greater than a width of said opening in the lever, and a width in another direction that is less than the width of said opening in the lever, such that said locking member is rotatable to a position at which it can pass through the opening in the lever and thereby allow the lever to be pivoted in said first direction.

13. The rotary device according to claim 12, wherein said locking member is also slidable axially along said rod, and said safety mechanism further comprises at least one spring disposed on said rod and engaging said locking member so as to resiliently support said locking member.

14. The rotary device according to claim 11, wherein said spindle and said head have outer circumferential flanges, respectively, and said annular clamping frame has a groove extending along the inner circumferential surface thereof, said flanges being received in said groove.

15. The rotary device according to claim 11, wherein said first arm of the clamping frame is arcuate, said second arm of the clamping frame is arcuate, and said first and second arms are hinged to one another at respective second ends thereof remote from said free ends.

16. The rotary device according to claim 15, wherein said projection is unitary with said first arm.

17. The rotary device according to claim 11, wherein said another end of said fastener has the form of a loop.

18. The rotary device according to claim 11, wherein said head is a rotary wafer chuck of a chemical mechanical polishing apparatus.

* * * * *